US009084522B2

(12) United States Patent
Conrad

(10) Patent No.: US 9,084,522 B2
(45) **Date of Patent: *Jul. 21, 2015**

(54) SURFACE CLEANING APPARATUS

(71) Applicant: G.B.D. CORP., Nassau (BS)

(72) Inventor: Wayne Ernest Conrad, Hampton (CA)

(73) Assignee: G.B.D. CORP., Nassau (BS)

( * ) Notice: Subject to any disclaimer, the term of this patent is extended or adjusted under 35 U.S.C. 154(b) by 0 days.

This patent is subject to a terminal disclaimer.

(21) Appl. No.: 14/488,449

(22) Filed: Sep. 17, 2014

(65) Prior Publication Data

US 2015/0000073 A1 Jan. 1, 2015

Related U.S. Application Data

(63) Continuation of application No. 11/953,292, filed on Dec. 10, 2007, now Pat. No. 8,869,344.

(60) Provisional application No. 60/893,990, filed on Mar. 9, 2007, provisional application No. 60/894,005, filed on Mar. 9, 2007, provisional application No. 60/869,586, filed on Dec. 12, 2006.

(51) Int. Cl.

| | |
|---|---|
| ***A47L 9/10*** | (2006.01) |
| ***A47L 5/24*** | (2006.01) |
| ***A47L 9/16*** | (2006.01) |

(52) U.S. Cl.

CPC . *A47L 5/24* (2013.01); *A47L 9/165* (2013.01); *A47L 9/1608* (2013.01); *A47L 9/1625* (2013.01); *A47L 9/1641* (2013.01); *A47L 9/1666* (2013.01)

(58) Field of Classification Search

USPC ..... 15/327.2, 327.5, 339, 352, 353

See application file for complete search history.

(56) References Cited

U.S. PATENT DOCUMENTS

| | | | |
|---|---|---|---|
| 280,033 | A | 6/1883 | Hadley |
| 303,173 | A | 8/1884 | Mark |
| 3,320,727 | A | 5/1967 | Farley et al. |
| 3,543,325 | A | 12/1970 | Hamrick et al. |
| 4,523,936 | A | 6/1985 | Disanza, Jr. |
| D280,033 | S | 8/1985 | Miyamoto et al. |
| D290,894 | S | 7/1987 | Miyamoto et al. |
| D298,875 | S | 12/1988 | Nakamura |
| D303,173 | S | 8/1989 | Miyamoto et al. |
| 5,035,024 | A | 7/1991 | Steiner et al. |

(Continued)

FOREIGN PATENT DOCUMENTS

| | | | |
|---|---|---|---|
| CN | 201523596 | U | 7/2010 |
| DE | 202005020767 | U1 | 8/2006 |

(Continued)

OTHER PUBLICATIONS

"Particulars of Claim", *Euro-Pro Operating LLC* vs. *Dyson Technology Limited*, Apr. 29, 2014, pp. 1-37.

(Continued)

*Primary Examiner* — Lee D Wilson
*Assistant Examiner* — Shantese McDonald
(74) *Attorney, Agent, or Firm* — Greenblum & Bernstein, P.L.C.

(57) ABSTRACT

A hand vacuum cleaner is provided with a wand mounted to the dirty fluid inlet of the hand vacuum cleaner and the wand has a distal inlet that is mounted on a surface cleaning head. The hand vacuum cleaner has a cyclonic cleaning stage. Fluid exiting the wand travels directly into the dirty fluid inlet and, from the dirty fluid inlet, directly into the cyclone chamber.

22 Claims, 13 Drawing Sheets

(56) References Cited

U.S. PATENT DOCUMENTS

| | | | | |
|---|---|---|---|---|
| 5,287,591 | A | 2/1994 | Rench et al. | |
| 5,307,538 | A | 5/1994 | Rench et al. | |
| 5,363,535 | A | 11/1994 | Rench et al. | |
| D353,917 | S | 12/1994 | Hoekstra et al. | |
| 5,379,483 | A | 1/1995 | Pino | |
| D436,699 | S | 1/2001 | Makihara et al. | |
| 6,228,260 | B1 | 5/2001 | Conrad et al. | |
| 6,406,505 | B1 * | 6/2002 | Oh et al. | 55/337 |
| 6,613,129 | B2 | 9/2003 | Gen | |
| D498,027 | S | 11/2004 | Alsruh et al. | |
| 6,840,972 | B1 * | 1/2005 | Kim | 55/337 |
| 6,883,202 | B2 | 4/2005 | Steffen et al. | |
| 6,974,488 | B2 | 12/2005 | Dyson | |
| 7,028,369 | B2 | 4/2006 | Park et al. | |
| 7,485,164 | B2 * | 2/2009 | Jeong et al. | 55/337 |
| D591,466 | S | 4/2009 | Crawley | |
| 7,526,833 | B2 * | 5/2009 | Cochran et al. | 15/327.2 |
| 7,544,224 | B2 | 6/2009 | Tanner et al. | |
| D598,616 | S | 8/2009 | Crawley | |
| 7,887,612 | B2 | 2/2011 | Conrad | |
| D635,728 | S | 4/2011 | Fjellman | |
| 7,931,716 | B2 | 4/2011 | Oakham | |
| 8,117,712 | B2 | 2/2012 | Dyson | |
| 8,127,398 | B2 | 3/2012 | Conrad | |
| 8,156,609 | B2 | 4/2012 | Milne et al. | |
| 8,236,077 | B2 | 8/2012 | Gomiciaga-Pereda et al. | |
| 8,302,250 | B2 | 11/2012 | Dyson et al. | |
| 8,347,455 | B2 | 1/2013 | Dyson et al. | |
| 8,387,204 | B2 | 3/2013 | Dyson | |
| 8,707,513 | B2 | 4/2014 | Ivarsson et al. | |
| 2001/0023517 | A1 | 9/2001 | Onishi et al. | |
| 2004/0020005 | A1 | 2/2004 | Odachi et al. | |
| 2006/0123590 | A1 | 6/2006 | Fester et al. | |
| 2006/0130448 | A1 | 6/2006 | Han et al. | |
| 2006/0207055 | A1 | 9/2006 | Ivarsson et al. | |
| 2007/0067943 | A1 | 3/2007 | Makarov | |
| 2007/0271724 | A1 | 11/2007 | Hakan et al. | |
| 2008/0047091 | A1 | 2/2008 | Nguyen | |
| 2009/0165242 | A1 | 7/2009 | Lee et al. | |
| 2009/0313958 | A1 | 12/2009 | Gomiciaga-Pereda et al. | |
| 2010/0154150 | A1 | 6/2010 | McLeod | |
| 2011/0219566 | A1 | 9/2011 | Dyson et al. | |
| 2011/0219571 | A1 | 9/2011 | Dyson et al. | |
| 2012/0030896 | A1 | 2/2012 | Crouch et al. | |

FOREIGN PATENT DOCUMENTS

| | | | |
|---|---|---|---|
| EM | D000780341 | | 9/2007 |
| EM | D000915269 | | 10/2010 |
| EP | 0 489 468 | A1 | 6/1992 |
| EP | 1 356 755 | A2 | 10/2003 |
| EP | 1 356 755 | B1 | 5/2012 |
| GB | 2 035 787 | | 10/1982 |
| GB | D1038414 | | 8/1987 |
| GB | 2251178 | A | 7/1992 |
| GB | 2 268 875 | A | 1/1994 |
| GB | 2 377 880 | A | 1/2003 |
| GB | D3017095 | | 5/2004 |
| GB | 2 409 404 | B | 11/2005 |
| GB | 2 441 962 | A | 3/2008 |
| GB | 2466290 | A | 6/2010 |
| GB | 2478614 | B | 2/2012 |
| GB | 2484146 | B | 2/2013 |
| GB | 2478599 | | 7/2014 |
| JP | 609203 | | 9/1983 |
| JP | 745201 | | 10/1983 |
| JP | 649078 | | 4/1985 |
| JP | 649084 | | 4/1985 |
| JP | 60-220027 | A | 11/1985 |
| JP | 679295 | | 5/1986 |
| JP | 679390 | | 5/1986 |
| JP | 679426 | | 5/1986 |
| JP | 679806 | | 5/1986 |
| JP | 61-131720 | | 6/1986 |
| JP | 706192 | | 5/1987 |
| JP | 706193 | | 5/1987 |
| JP | 725983 | | 2/1988 |
| JP | 679426 | | 3/1988 |
| JP | 726042 | | 3/1988 |
| JP | 726318 | | 3/1988 |
| JP | 743059 | | 9/1988 |
| JP | 743445 | | 9/1988 |
| JP | 743603 | | 9/1988 |
| JP | 743618 | | 9/1988 |
| JP | 743619 | | 9/1988 |
| JP | 63-246116 | A | 10/1988 |
| JP | 745200 | | 10/1988 |
| JP | 943287 | | 11/1988 |
| JP | 64-15020 | | 1/1989 |
| JP | 787941 | | 5/1990 |
| JP | 788426 | | 5/1990 |
| JP | 788427 | | 5/1990 |
| JP | 8289861 | | 11/1996 |
| JP | 2000-083879 | | 3/2000 |
| JP | D1115813 | | 7/2001 |
| JP | D1310024 | | 9/2007 |
| JP | D1370915 | | 10/2009 |
| KR | 30-0360565 | | 9/2004 |
| WO | 2004/069021 | | 8/2004 |
| WO | 2008/009888 | | 1/2008 |
| WO | 2012/042240 | | 4/2012 |

OTHER PUBLICATIONS

"Instruction Manual for Cordless Cleaner", Makita, pp. 1-32.
Canadian Office Action in No. 2,675,714, Jul. 7, 2010.
IPRP and Written Opinion in PCT/CA2007/002211, Dec. 12, 2006.
What's the Best vacuum.com Forum discussion Dyson DC16 Root 6 Hand Held Vacuum Cleaner; http://www.abbysguide.com/vacuum/legacy/cgi-bin/yabb/2618~YaBB.html; dated Oct. 21, 2006.

* cited by examiner

SURFACE CLEANING APPARATUS

CROSS REFERENCES TO RELATED APPLICATIONS

This application claims priority from U.S. patent application Ser. No. 11/953,292 which was filed on Dec. 10, 2007, which is allowed, and which claimed priority from U.S. Provisional applications 60/894,005 (filed on Mar. 9, 2007), 60/893,990 (filed on Mar. 9, 2007), and 60/869,586 (filed on Dec. 12, 2006), all of which are incorporated herein by reference in their entirety.

FIELD OF THE INVENTION

The invention relates to surface cleaning apparatuses such as vacuum cleaners, wet/dry vacuum cleaner and carpet extractors. More particularly, the invention relates to surface cleaning apparatuses, which have a dirt bin having an off-centre inlet.

BACKGROUND

Surface cleaning apparatus have been developed which include one or more cyclonic cleaning stages. Each cleaning stage may include a single cyclone, or a plurality of cyclones positioned in parallel. Typically, in cleaning stages comprising a single cyclone, a dirt bin is positioned below the cyclone. The cyclone has an outlet, which is in fluid communication with an inlet of the dirt bin. Typically, the dirt bin and the cyclone are coaxial. The inlet to the dirt bin comprises an opening centrally positioned in an upper surface of the dirt bin.

For example, United States Patent Application Publication 2006/0130448 to Han et al. discloses a cyclone having a cubic dirt bin. The dirt bin is centrally positioned below the cyclone, such that the dirt bin and the cyclone are coaxial. A dirt inlet is positioned at the centre of the upper square surface of the dirt bin, aligned with a dirt outlet of the cyclone.

United States Patent Application Publication 2006/0123590 to Fester et al. discloses a surface cleaning apparatus having a first cleaning stage including a single cyclone, and a second cleaning stage including a plurality of cyclones in parallel. The cyclones of the second cleaning stage are arranged annularly around the cyclone of the first cleaning stage. The dirt bin of the first cleaning stage is coaxial with the cyclone of the first cleaning stage, and extends outwardly such that a portion is positioned underneath the cyclones of the second cleaning stage. The dirt inlet to the dirt bin is annular, and is centered about the longitudinal axis of the dirt bin.

SUMMARY

In one broad aspect, a surface cleaning apparatus is provided which has a collection chamber having an inlet that is off-centre from the centre of the collection chamber.

For example, the surface cleaning apparatus may comprise a fluid flow path extending from a dirt inlet to a clean fluid outlet, and a fluid flow motor positioned in the fluid flow path. A cyclonic cleaning stage is provided in the fluid flow path and comprises at least one, and preferably one, cyclone chamber. At least one dirt chamber is in fluid communication with the cyclone chamber and is positioned below the cyclone chamber. The dirt chamber has an upper portion proximate the cyclone chamber, a lower portion, a central axis extending vertically between the upper portion and the lower portion, and a dirt chamber inlet spaced from the central axis. The inlet is preferably provided in the top of the dirt chamber.

Embodiments in accordance with this broad aspect may be advantageous because the dirt chamber may have a larger cross sectional area than the cross sectional area of the cyclone chamber. Accordingly, the amount of dirt and/or water that may be collected in the dirt collection bin is increased. Further, the frequency with which the dirt chamber requires emptying is decreased. Further, by positioning the inlet off centre, the part of the dirt chamber distal to the inlet is more isolated from any fluid flow effects at the dirt inlet, thereby enhancing dirt retention in the dirt chamber.

In some embodiments, the upper portion of the dirt chamber has a width, and the dirt chamber inlet is spaced from the central axis by distance of at least 10% of the width. In further embodiments, the dirt chamber inlet is spaced from the central axis by distance of at least 15% of the width. In yet further embodiments, the dirt chamber inlet is spaced from the central axis by distance of at least 25% of the width.

In some embodiments, the cyclonic cleaning stage comprises a single cyclone having a dirt outlet positioned at the dirt chamber inlet, which is defined in an upper surface of the dirt chamber.

In some embodiments the surface cleaning apparatus comprises a generally transversely extending plate positioned adjacent the dirt chamber inlet. In further embodiments, the plate is positioned in the dirt chamber below the dirt chamber inlet.

In some embodiments, the upper portion has a perimeter, and the dirt chamber inlet is proximate the perimeter.

In some embodiments, the cyclone chamber has a longitudinal axis, and the central axis of the dirt chamber is spaced from the longitudinal axis.

In some embodiments, the dirt chamber is cylindrical.

In some embodiments, the dirt chamber comprises at least two sidewalls that meet at an angle. Such embodiments may be advantageous because the configuration of the sidewalls may prevent cyclonic motion in the dirt chamber. Accordingly, the amount of dirt in the dirt chamber, which becomes re-entrained in air may be reduced.

In some embodiments, the cyclonic cleaning stage has a maximum cross sectional area in a plane transverse to the a longitudinal axis of the cyclonic cleaning stage and the dirt chamber has a maximum cross sectional area in a plane transverse to the central axis that is larger than the maximum cross sectional area of the cyclonic cleaning stage.

In some embodiments, the maximum cross sectional area of the dirt chamber is at least 50% larger than the maximum cross sectional area of the cyclonic cleaning stage.

In another broad aspect, a surface cleaning apparatus is provided. The surface cleaning apparatus comprises a fluid flow path extending from a dirt inlet to a clean fluid outlet, and a fluid flow motor positioned in the fluid flow path. The surface cleaning apparatus further comprises a first cyclonic cleaning stage comprising a cyclone chamber. A dirt chamber is in fluid communication with the cyclone chamber and positioned below the cyclone chamber. The dirt chamber has a dirt chamber inlet that is off-centre.

In some embodiments, the dirt chamber has an upper portion proximate the cyclone chamber, a lower portion, and a central axis extending vertically between the upper portion and the lower portion, and the dirt chamber inlet is spaced from the central axis.

In some embodiments, the dirt chamber has a width, and the dirt chamber inlet is off-centre by a distance of at least 10% of the width. In further embodiments, the dirt chamber inlet is off-centre by a distance of at least 15% of the width. In yet further embodiments, the dirt chamber inlet is off-centre by a distance of at least 25% of the width.

In some embodiments, the surface cleaning apparatus further comprises a generally transversely extending plate positioned adjacent the dirt chamber inlet.

In some embodiments, a plate is provided in a flow path from the cyclone chamber to the dirt chamber. In further embodiments, the plate is provided in the dirt chamber.

In some embodiments, the dirt chamber inlet comprises a dirt outlet of the cyclone chamber.

In some embodiments, the upper portion defines a perimeter, and the dirt chamber inlet is proximate the perimeter.

In some embodiments, the surface cleaning apparatus further comprises a second cyclonic cleaning stage downstream from the cyclone. In some such embodiments, the second cyclonic cleaning stage comprises a plurality of cyclone in parallel. In some further embodiments, the first cyclonic cleaning stage comprises a single cyclone.

BRIEF DESCRIPTION OF THE DRAWINGS

These and other advantages of the present invention will be more fully and particularly understood in connection with the following description of the preferred embodiments of the invention in which:

FIGS. 3A to 5A are top views of various embodiments of a dirt chamber of the present invention;

FIGS. 3B to 5B are side views of the embodiments of FIGS. 3A to 5A;

FIGS. 3C-5C are perspective views of the embodiments of FIGS. 3A to 5A;

DETAILED DESCRIPTION OF THE INVENTION

Figure 1A:
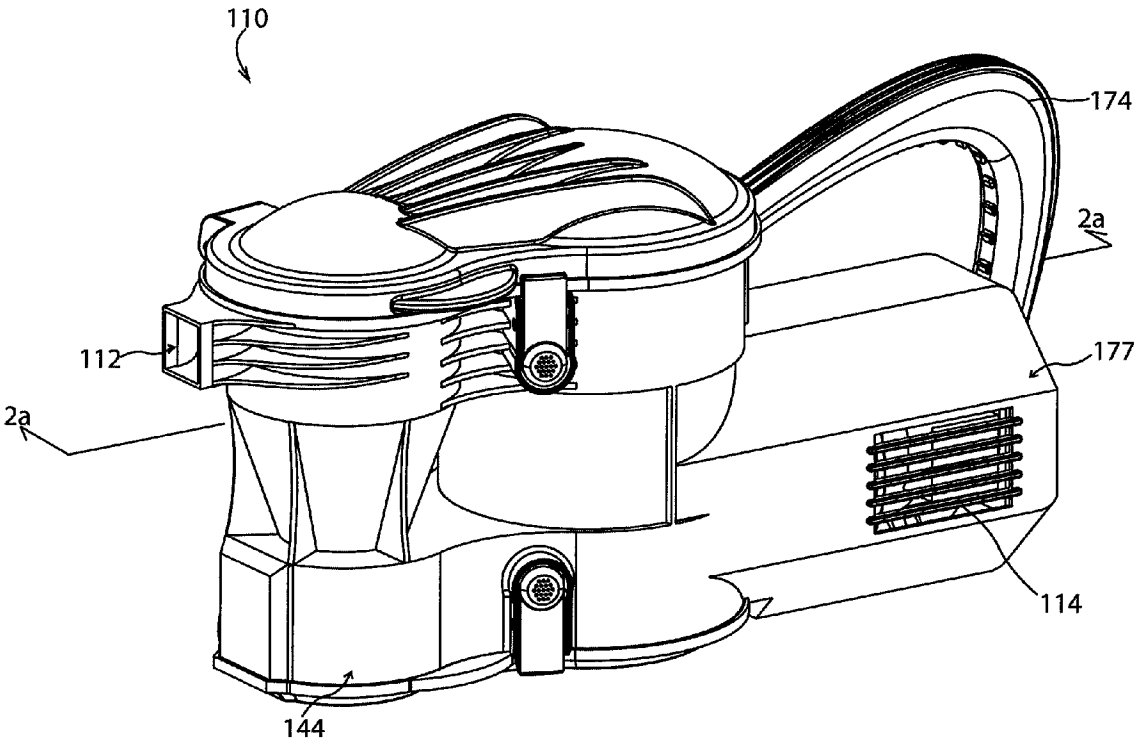
FIG. 1A is a perspective illustration of an embodiment of a surface cleaning apparatus of the present invention.
Figure 1B:
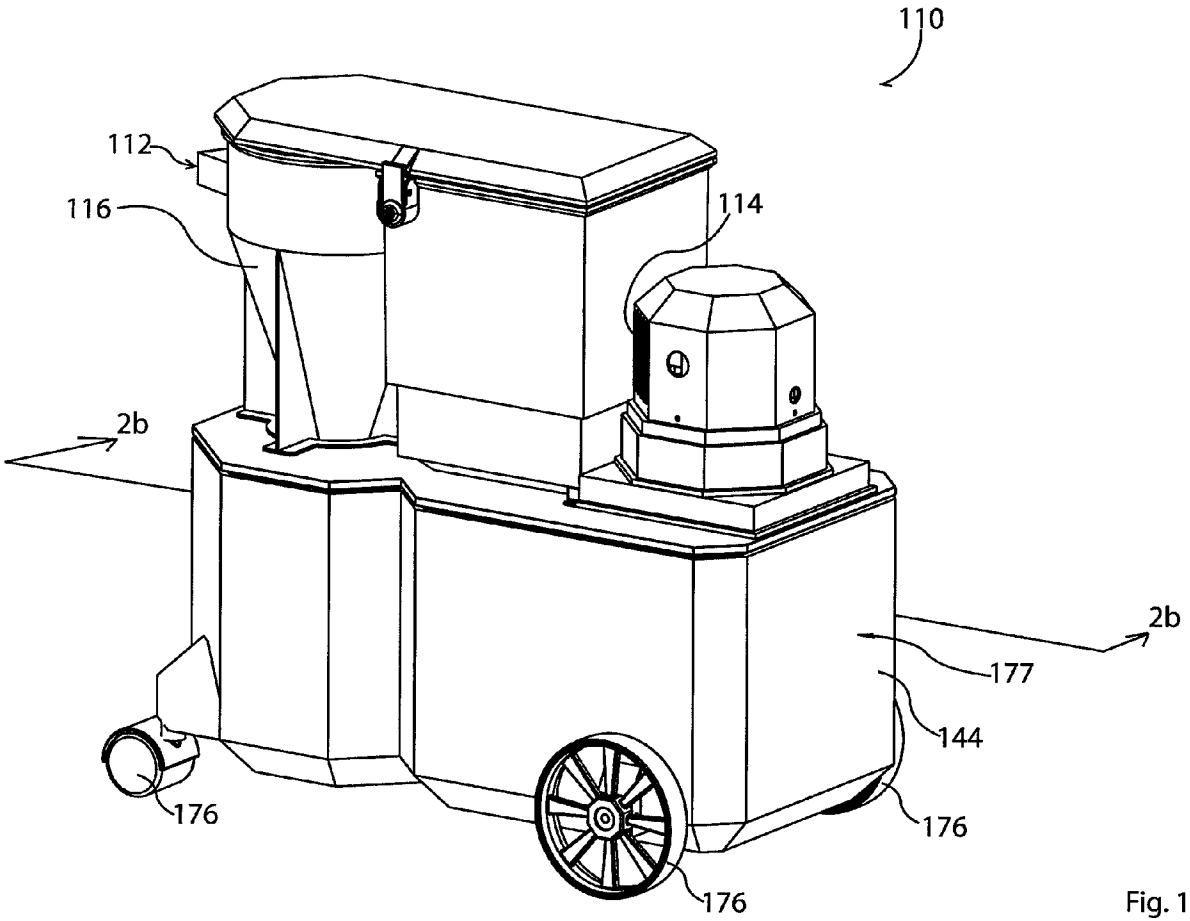
FIG. 1B is a perspective illustration of another embodiment of a surface cleaning apparatus of the present invention.
Figure 1C:
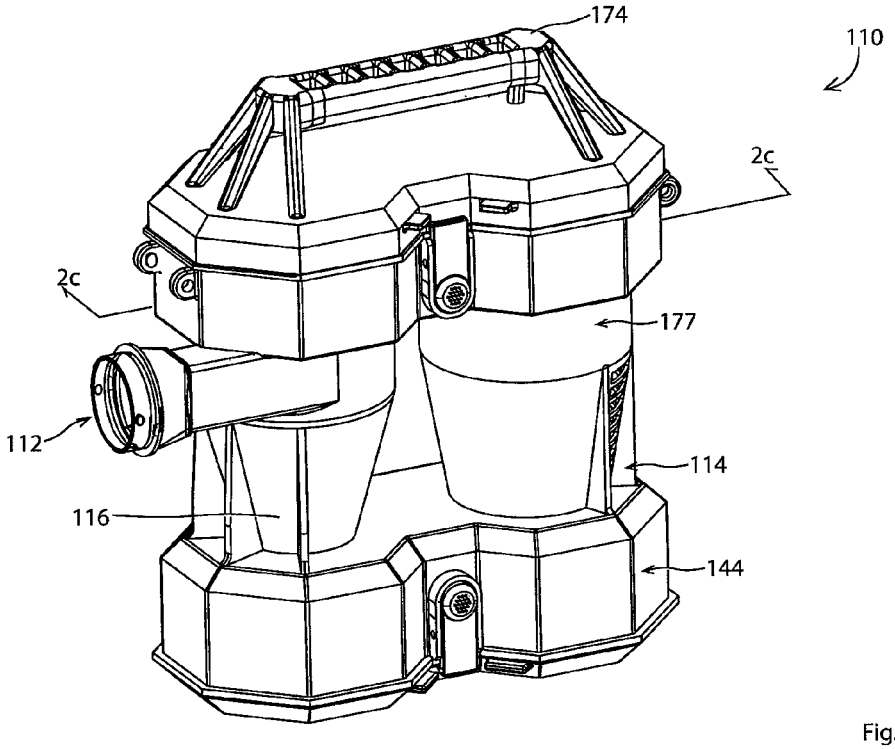
FIG. 1C is a perspective illustration of another embodiment of a surface cleaning apparatus of the present invention.
Figure 1D:
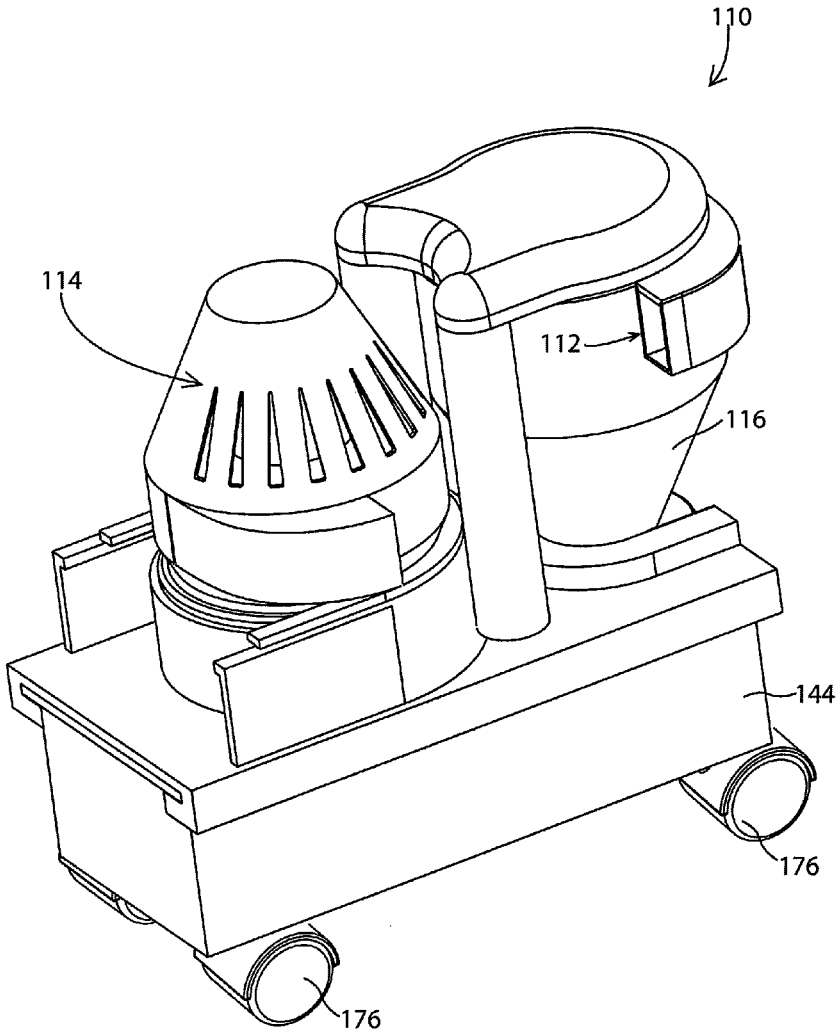
FIG. 1D is a perspective illustration of another embodiment of a surface cleaning apparatus of the present invention.

Embodiments of a surface cleaning apparatus 110 of the present invention are shown in FIGS. 1A-1D. As shown in FIGS. 1A and 1C, the surface cleaning apparatus 110 may be a hand vacuum cleaner, which may be converted to a shoulder strap vacuum cleaner by the addition of a shoulder strap (not shown). Alternatively, as shown in FIGS. 1B and 1D, the surface cleaning apparatus 110 may be a shop-vac or wet/dry type vacuum cleaner. In other embodiments, the surface cleaning apparatus 110 may be another type of surface cleaning apparatus, for example an upright vacuum cleaner, a canister type vacuum cleaner, a stick vacuum cleaner, a back pack vacuum cleaner, a carpet extractor or the like.

The surface cleaning apparatus 110 comprises a dirty fluid inlet 112, a clean fluid outlet 114, and a fluid flow path extending therebetween. At least one cyclonic cleaning stage 116 is provided in the fluid flow path. A fluid flow motor 118 is positioned in the fluid flow path for drawing a fluid (e.g. air or water) from the dirty fluid inlet 112 to the clean fluid outlet 114. The surface cleaning apparatus may draw in water and/or air that may have entrained therein dirt through inlet 112 and discharge air through outlet 114. The water and/or dirt will accumulate in dirt chamber 144.

Referring to FIGS. 2A to 2D, dirty fluid entering dirty fluid inlet 112 is directed to cyclonic cleaning stage 116. As is known in the art, a hose or wand having a distal inlet that may be mounted on a surface cleaning head may be attached to inlet 112. In the embodiments shown, cyclonic cleaning stage 116 comprises a single cyclone chamber 120 extending longitudinally along a first longitudinal axis 122. In other embodiments, cyclonic cleaning stage 116 may comprise a plurality of cyclones. Cyclone chamber 120 comprises a clean air outlet 124, and a dirt and/or water outlet 126. A dirt chamber 144, as will be described further hereinbelow, is positioned below dirt outlet 126. It will be appreciated that other cleaning or treatment stages may be provided upstream of the cyclone inlet.

In some embodiments, air exiting cyclone chamber 120 may be directed past motor 118, and out of clean fluid outlet 114. Alternatively, air exiting cyclone chamber 120 may be directed to one or more additional cleaning stages, such as another component, for example housing a filter prior to flowing to motor 118. The second cleaning 128 stage comprises a plurality of second cyclones 130 in parallel.

Figure 2A:
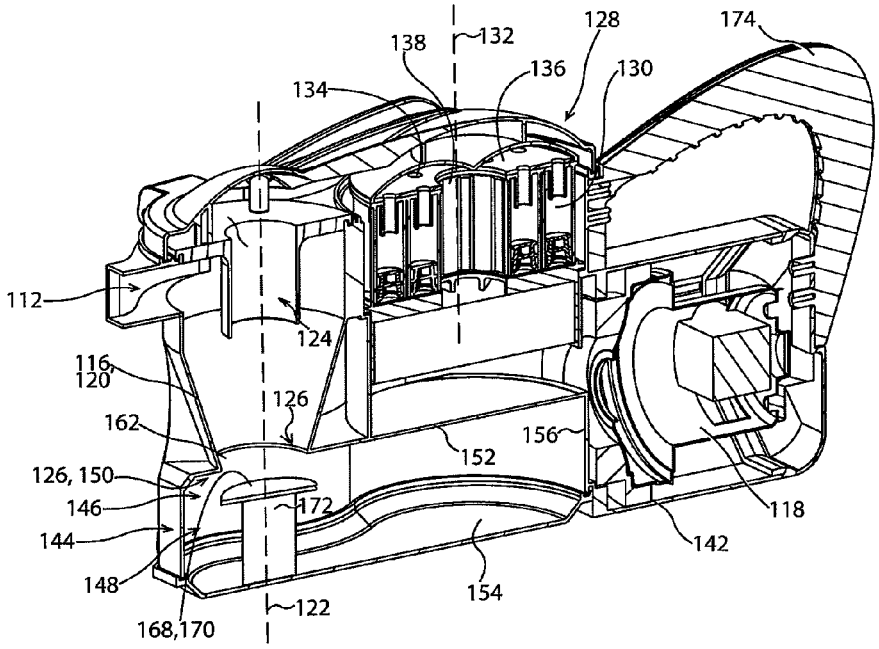
FIG. 2A is a cross-sectional view of the embodiment of FIG. 1A, taken along line 2A-2A.
Figure 2B:
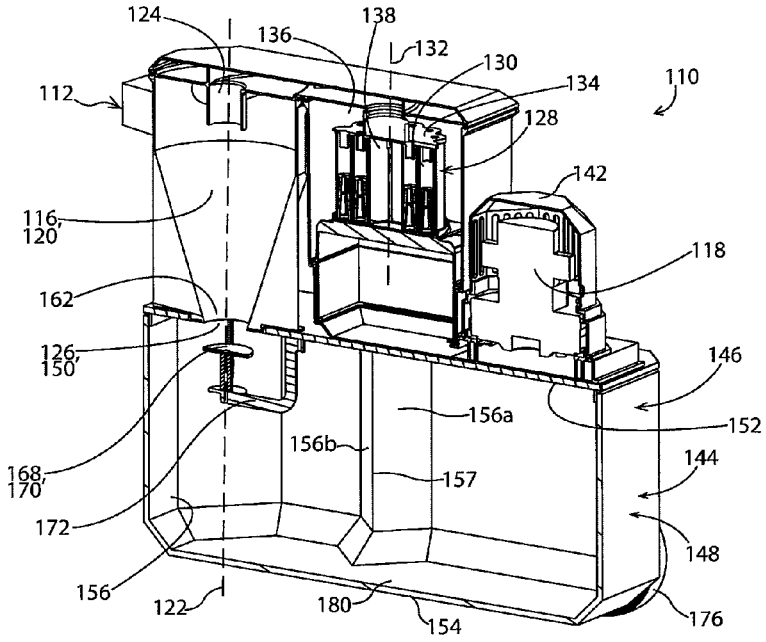
FIG. 2B is a cross sectional view of the embodiment of FIG. 1B, taken along line 2B-2B.
Figure 2C:
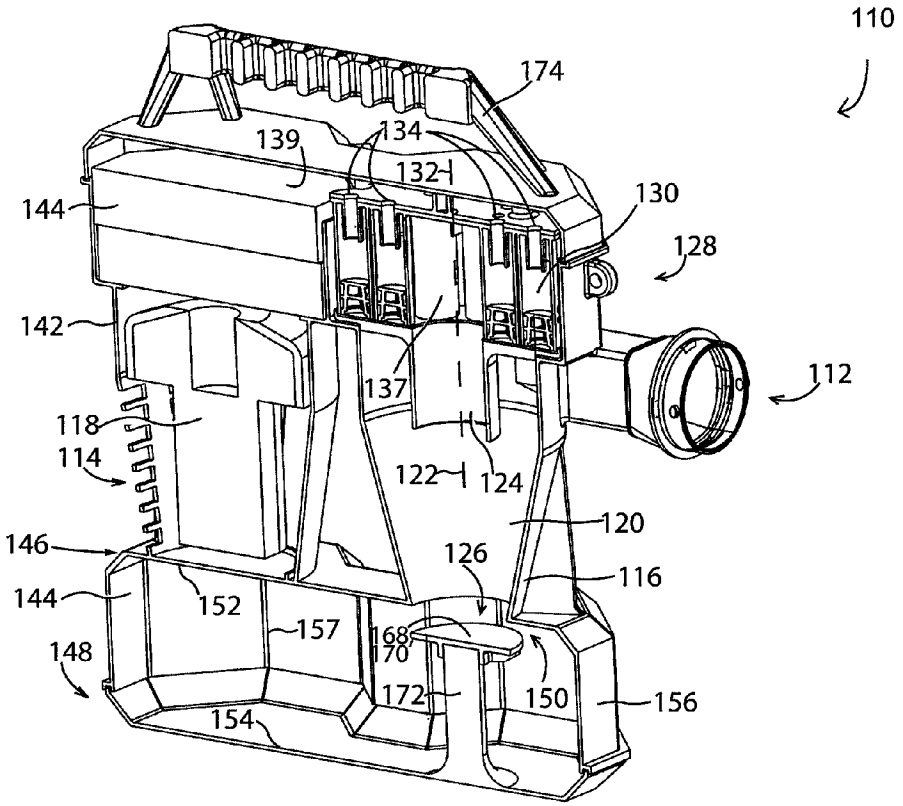
FIG. 2C is a cross sectional view of the embodiment of FIG. 10, taken along line 2C-2C.
Figure 2D:
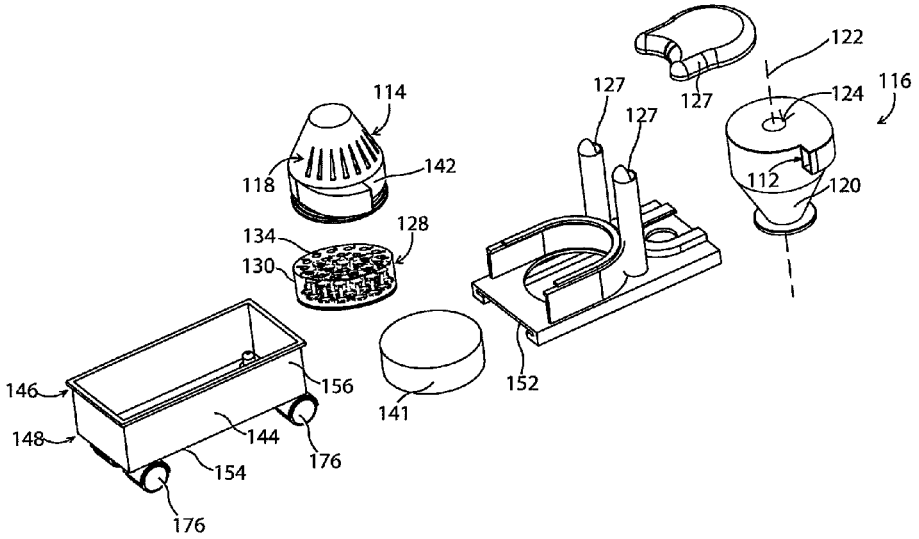
FIG. 2D is an exploded view of the embodiment of FIG. 1D.

The second cleaning stage 128 has, in the examples illustrated, a generally cylindrical configuration with a second longitudinal axis 132. In the embodiments of FIGS. 2A, 2B, and 2D, the second axis 132 is parallel to, and laterally offset from, first axis 122. In the embodiment of FIG. 2C, the second axis 132 is parallel to and aligned with first axis 122. In the embodiments shown in FIGS. 2A and 2B, each of the second cyclones 130 in the assembly receives air from the clean air outlet 124 of the first cyclone, and discharges air through outlets 134 into a manifold 136. Air is evacuated from the manifold 136 through a conduit 138 disposed centrally of the assembly. From the conduit 138 the air is drawn towards the motor 118, and expelled from the apparatus 110 through the exhaust 114. In the embodiment of FIG. 2C, each of the second cyclones 130 receives air from the clean air outlet 124 of the first cyclone via a conduit 137, and discharges air via outlets 134 into a manifold 139. From manifold 139, the air is drawn through a filter 141, and past motor 118. In the embodiment of FIG. 2D, each of the second cyclones 130 receives air from the clean air outlet 124 of the first cyclone via a conduits 127, and discharges air via outlets 134 into a motor housing 142. Alternately or in addition, in some embodiments the additional cleaning stage 128 may include a filter element, such as a pre-motor foam membrane, disposed in the fluid stream between the cleaning stage 128 and the motor 118.

In the embodiments shown in FIGS. 2A-2C, motor 118 is disposed laterally adjacent the additional cleaning stage 128, in a motor housing 142. In the embodiment of FIG. 2D, motor 118 is disposed laterally adjacent the first cleaning stage above the additional cleaning stage, namely filters 141 and second cyclonic cleaning stage 128. In the embodiment of FIG. 2A, motor 118 extends transverse to first longitudinal axis 122. In the embodiment of FIGS. 2B-2D, motor 118 extends parallel to first longitudinal axis 122. The motor 118 is, in the examples illustrated, offset from the second cleaning stage 128, having a portion that abuts or is adjacent at least a portion of the dirt chamber. It will also be appreciated that motor housing may be adjacent both the first and second housings and, thereby defining a generally triangular configuration in top plan view. Motor 118 may alternately be positioned at any other location known in the surface cleaning arts, such as above or below the cyclonic cleaning stage.

As previously mentioned, cyclone chamber 120 is in fluid communication with a dirt chamber 144, which is positioned below the dirt outlet 126. Dirt chamber 144 serves to collect dirt that is removed, e.g., from the air passing through cyclone chamber 120 or water drawn in through inlet 112. Dirt chamber 144 may be of any configuration known in the art provided the dirt chamber inlet 150 is off centre. As exemplified, dirt chamber 144 comprises an upper portion 146, which is proximate cyclone chamber 120, and a lower portion 148. Dirt chamber 144 is bounded by at least one wall. In the embodiments shown, dirt chamber 144 is bounded by a top wall 152 a bottom wall 154, and at least one sidewall 156.

Dirt chamber 144 further comprises a dirt chamber inlet 150, which is preferably defined in upper portion 146, and more preferably defined in top wall 152. Dirt chamber inlet 150 is in fluid communication with dirt outlet 126 of cyclone chamber 120. In some embodiments, as shown, dirt chamber inlet 150 and dirt outlet 126 may coincide. In other embodiments, dirt chamber inlet 150 and dirt outlet 126 may be separate, and may have a channel or passage providing fluid communication therebetween (not shown).

Dirt chamber inlet 150 may be of a variety of shapes and sizes. In the preferred embodiment, dirt chamber inlet 150 has a circular outer perimeter 162. In further embodiments, wherein surface cleaning apparatus 110 comprises a divider plate, as will be described further hereinbelow, dirt chamber inlet 150 may be substantially annular.

Dirt chamber 144 may be of a variety of shapes and sizes. For example, in the embodiment of FIGS. 1A, 2A, and 5A-5C, dirt chamber 144 comprises two substantially rounded lobes having curved sidewalls 156. In the embodiment of FIGS. 1B, 2B, 10 and 2C, dirt chamber 144 comprises two lobes which comprise substantially straight sidewalls 156. In the embodiment of FIGS. 1D, 2D, and 3A-3C, dirt chamber 144 comprises a single rectangular chamber. In the embodiment of FIGS. 4A-4C, dirt chamber 144 comprises a single trapezoidal chamber.

In some embodiments shown, dirt chamber 144 comprises at least two sidewalls which meet at an angle. For example, in the embodiment of FIGS. 2B-2D, sidewalls 156*a* and 156*b* meet at a corner 157. Such embodiments may be advantageous because cyclonic action in the dirt chamber may be minimized or reduced by providing the dirt chamber with sidewalls, which meet at an angle. Accordingly, dirt in the dirt chamber may be prevented from being re-entrained the circulating air. In other embodiments, dirt chamber 144 may be of another shape. For example dirt chamber 144 may be cylindrical.

In the embodiments shown, dirt chamber 144 extends laterally beyond the cyclone chamber 120. That is, if cyclonic cleaning stage 116 has a maximum cross sectional area in a plane transverse to axis 122 (e.g. parallel to bottom wall 154), and dirt chamber 144 has a maximum cross sectional area in a plane transverse to axis 122 (e.g. parallel to bottom wall 154), the maximum cross sectional area of dirt chamber 144 is greater than the maximum cross sectional area of cyclonic cleaning stage 116. In some particular embodiments, the maximum cross sectional area of dirt chamber 144 is at least 25% larger, more preferably at least 50% larger and most preferably at least 75% larger than the maximum cross sectional area of cyclonic cleaning stage 116. Such embodiments may be advantageous because the overall volume of the dirt chamber may be increased without increasing the footprint of surface cleaning apparatus 110. In the embodiment of FIGS. 1A, 1C and 1D, dirt chamber 128 extends laterally such that a portion thereof is positioned beneath second cleaning stage 128. In the embodiment of FIG. 2A, dirt chamber 128 extends laterally such that a portion thereof is positioned beneath second cleaning stage 128, and motor 118.

It will be appreciated that in an alternate embodiment, dirt chamber 144 may have a cross sectional area in a plane transverse to axis 122 that is essentially the same as the cross sectional area of the cyclone 116 in a plane transverse to axis 122. This may be achieved by placing inlet 150 below inlet 126 but at adjacent sidewall 156. Thus the inlet 150 is off centre and dirt chamber 144 may be underneath only a portion of cyclone 116.

Figure 3A:
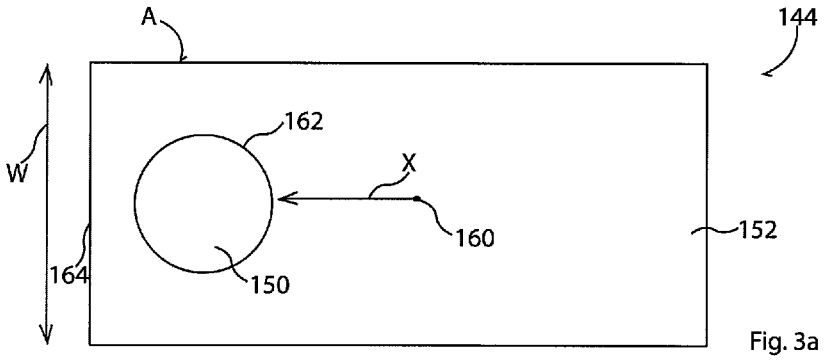
Figure 3B:
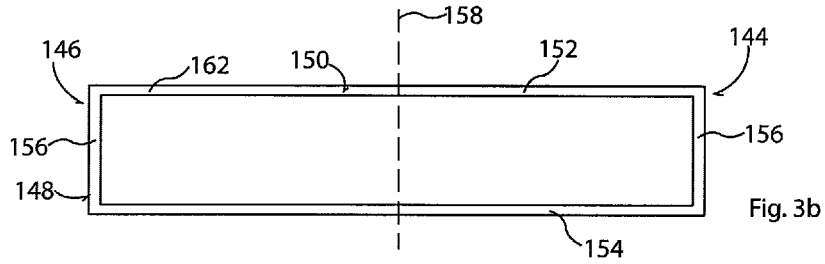
Figure 3C:
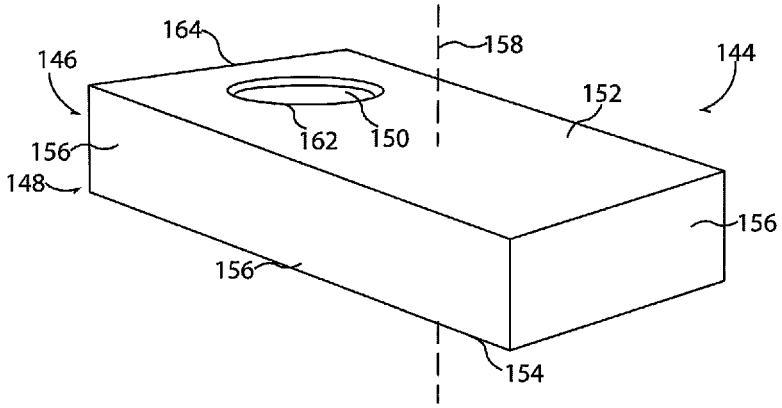
Figure 4A:
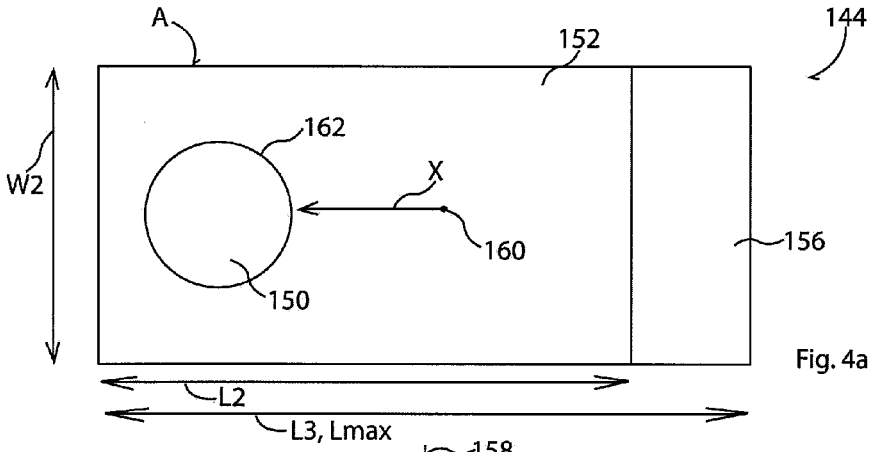
Figure 4B:
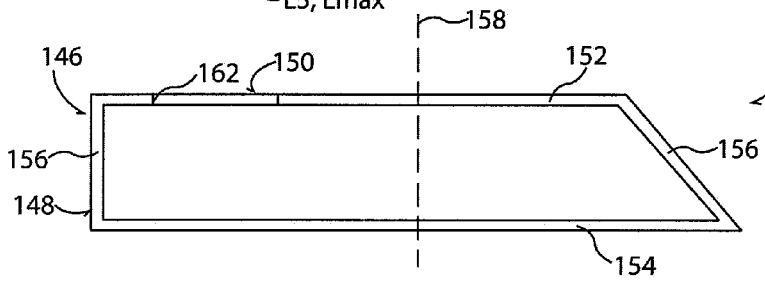
Figure 4C:
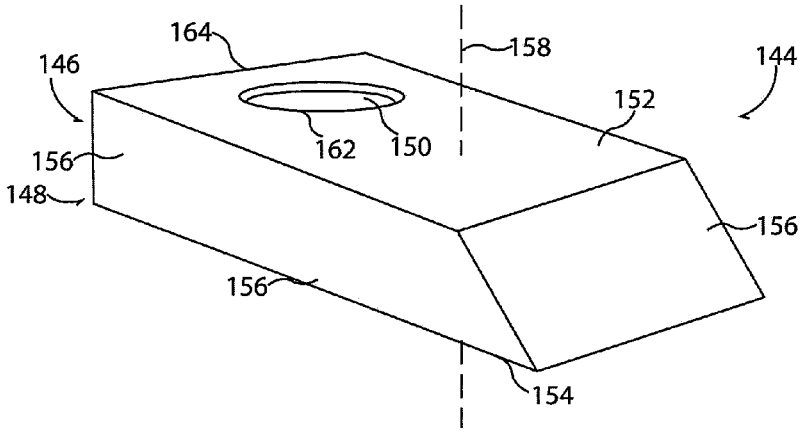
Figure 5A:
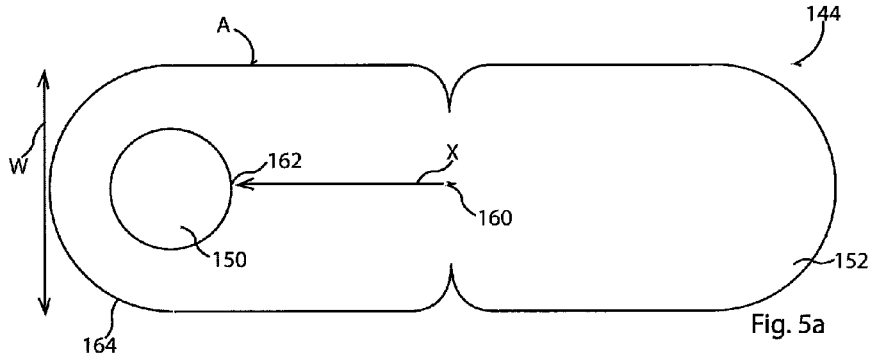
Figure 5B:
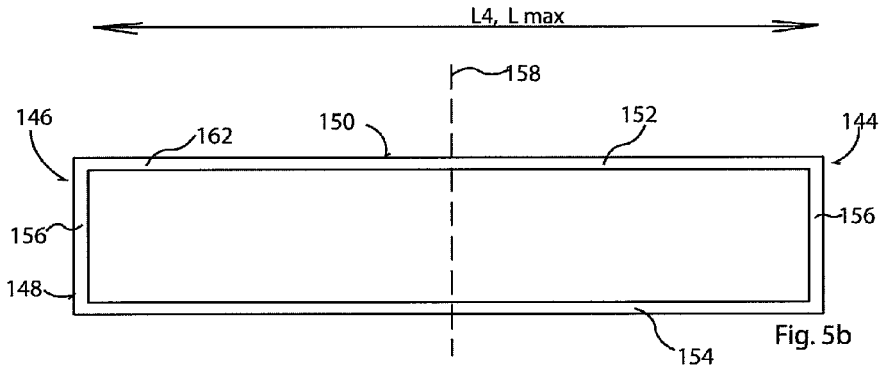
Figure 5C:
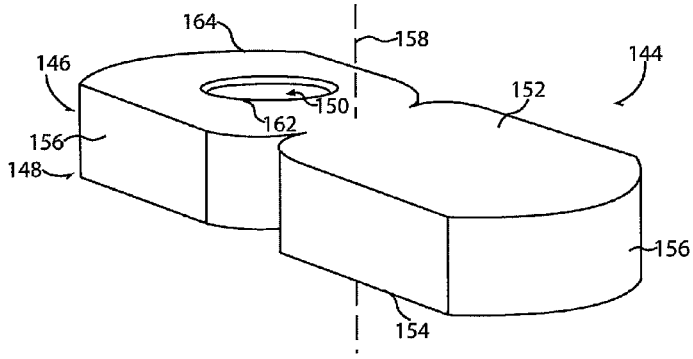

Referring to FIGS. 3A-3C, in some embodiments, dirt chamber 128 comprises a central axis 158 extending between upper portion 146, and lower portion 148. When surface cleaning apparatus 110 is positioned such that axis 122 extends vertically, central axis 158 may extend vertically between top wall 152 and bottom wall 154. Central axis 158 is positioned such that it extends through a centroid 160 of top wall 152. As used herein, the centroid of top wall 152 is defined as the point located centrally in the area A defined by dirt chamber 144 when viewed from above. For example, in the embodiment of FIGS. 3A-3C dirt chamber 144 is rectangular. When viewed from above, dirt chamber 130 has a Length $L_1$ and a width $W_1$, and centroid 160 is positioned at a point corresponding to $\frac{1}{2}L_1$ and $\frac{1}{2}W_1$. In another example, as shown in FIGS. 4A-4C, dirt chamber is substantially trapezoidal when viewed from the front. Accordingly, top wall 152 of dirt chamber 144 has a length $L_2$, bottom wall 154 of dirt chamber 144 has a length $L_3$, and dirt chamber 144 has a width $W_2$. When viewed from above, area A is defined by $L_3$ and $W_2$. Therefore, in this embodiment, centroid 160 is positioned at a point corresponding to $\frac{1}{2}L_3$ and $\frac{1}{2}W_2$. In another example, as shown in FIGS. 5A-5C, dirt chamber has two elongate and rounded lobes. When viewed from above, dirt chamber 144 has an overall width $W_3$, and an overall length $L_4$. The centroid 160 is positioned at a point corresponding to $\frac{1}{2}W_3$ and $\frac{1}{2}L_4$.

Dirt chamber inlet 150 is off centre with respect to dirt chamber 144. That is, dirt chamber inlet 150 is spaced from central axis. In further embodiments, central axis 158 is spaced from longitudinal axis 122. Such embodiments may allow for the volume of dirt chamber 144 to be increased, without substantially increasing the footprint of surface cleaning apparatus 110.

Referring to FIGS. 3A-5C, dirt chamber inlet 150 may be spaced from central axis 158 by a distance X, which is defined as the shortest distance between a perimeter 162 of dirt inlet 150, and central axis 158. Distance X may vary depending on a variety of factors. Dirt chamber inlet 150 may be spaced from the central axis by a distance of at least 10% of the maximum length, $L_{max}$. In a preferred embodiment, dirt chamber inlet 150 is spaced from central axis 158 by a distance of at least 15% of $L_{max}$. In a more preferred embodiment, dirt chamber inlet 150 is spaced from central axis 158 by a distance of at least 25% of $L_{max}$.

In some particular embodiments, as shown in FIGS. 5A-5C, the upper portion 146 of dirt chamber 144 has a perimeter 164, and dirt chamber inlet 150 is adjacent the perimeter.

Figure 6:
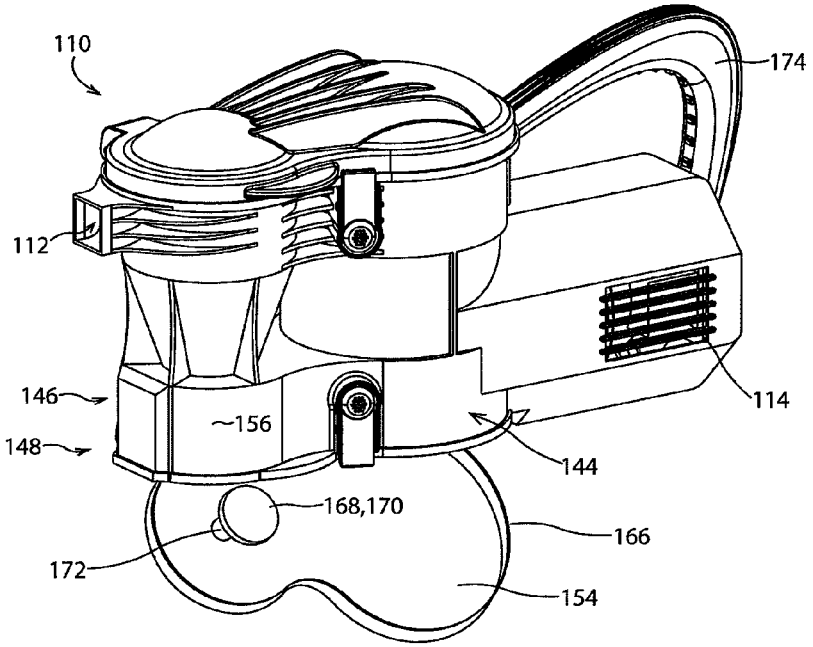
FIG. 6 is a perspective view of the surface cleaning apparatus of FIG. 1A, showing a panel in an opened position; and, FIG. 7 is a perspective view of the surface cleaning apparatus of FIG. 2A, showing a panel in an opened position.
Figure 7:
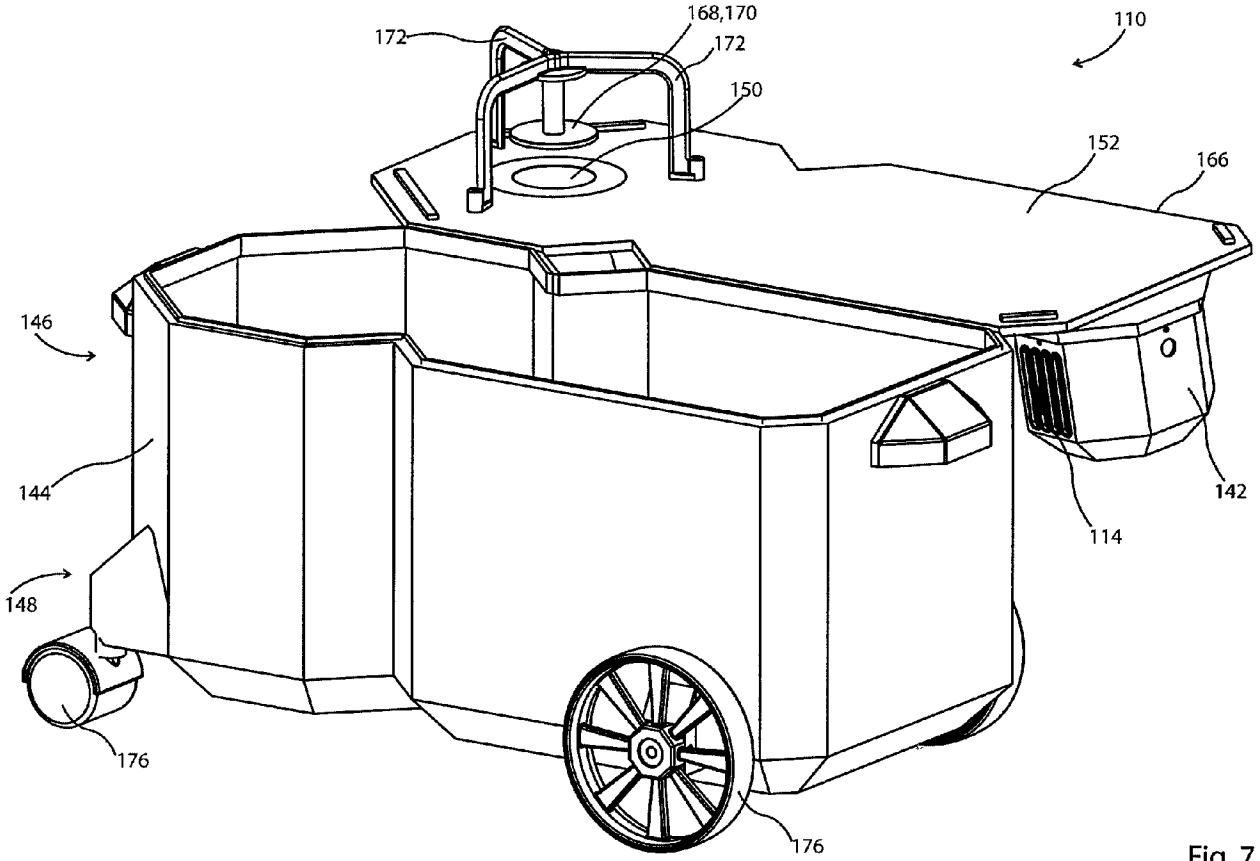

Referring to FIGS. 6 and 7, the dirt chamber 144 preferably has an openable panel 166 to facilitate emptying debris collected therein. In the embodiment of FIG. 6, panel 166 comprises bottom wall 15, which is movable between open and closed positions. The bottom wall is preferably pivotally mounted to at least one sidewall 156. In the embodiment of FIG. 7, panel 166 comprises top wall 152 of dirt chamber 132. In this embodiment, when panel 166 is opened, cyclonic cleaning stage 116, motor 118, and second cleaning stage 128 pivot together with panel 166. In other embodiments, dirt collection chamber 144 may be emptyable by any means known in the vacuum cleaner art. For example, dirt collection chamber 144 may be removably mounted to the surface cleaning apparatus or otherwise openable.

The apparatus 110 may also include a divider plate 168 positioned adjacent the dirt outlet 126 of the first cyclone chamber 120. In the example illustrated in FIGS. 2A-2C, the divider plate 168 is positioned within the dirt chamber 144, adjacent to but spaced below the dirt outlet 126. In other embodiments, divider palate 168 may be positioned within dirt outlet 126. In such an embodiment, dirt chamber inlet 150 may be defined between top wall 152 and divider plate 168, and may be substantially annular. The divider plate 168 may generally comprises a disc 170 that, when positioned below the dirt outlet 126, has a diameter slightly greater than the diameter of the dirt outlet 126, and disposed in facing relation to the dirt outlet 126. The disc 170 is, in the example illustrated, supported by a pedestal 172. In the embodiment of FIGS. 2A and 2C, pedestal 172 extends upwardly from bottom wall 154 of the dirt chamber 144. In the embodiment of FIG. 2B pedestal 172 extends downwardly from top wall 152 of dirt chamber 144. Alternately, plate 168 may be mounted to a sidewall 156 of the dirt collection chamber 144.

In the embodiment of FIGS. 1A and 10, the surface cleaning apparatus may be carried by a strap (not shown) or by using handle 174. In the embodiments of FIGS. 1B and 1D, the surface cleaning apparatus comprises one or more wheels 176, glides, or the like, for moving surface cleaning apparatus 110 along a surface.

In some embodiments, dirt chamber 144 preferably forms a portion of a casing member 177 for the apparatus 110 that is of a unitary, integral construction. For example, casing member 177 may comprise dirt chamber 144, the outer wall of cyclone chamber 120, a housing for the second cleaning stage 128, motor housing 142, and handle 174.

In some embodiments, dirt chamber 144 may comprise one or more liner bags 180, for example as shown in FIG. 2B, for lining dirt chamber 144 and aiding in emptying dirt chamber 144.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

I claim:

1. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (d) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber, wherein the passage axis intersects the handle.

2. The hand vacuum cleaner of claim 1 wherein an end of the handle is mounted to the hand vacuum cleaner at a position adjacent an upper end of the first cyclonic cleaning stage.

3. The hand vacuum cleaner of claim 2 wherein the hand vacuum cleaner has a lower dirt collection region, the cyclone chamber of the first cyclonic cleaning stage extends above the dirt collection region and the end of the handle is an upper end of the handle.

4. The hand vacuum cleaner of claim 1 wherein the first cyclonic cleaning stage comprises a dirt collection region that has a pivotally openable bottom.

5. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (d) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber, wherein the first cyclonic cleaning stage comprises a dirt collection region that has a pivotally openable bottom and the bottom is openable when the dirt collection region is attached to the main body.

6. The hand vacuum cleaner of claim 1 wherein the first end of the cyclone chamber is positioned above the second end of the cyclone chamber when the hand vacuum cleaner is positioned on a horizontal surface, the dirty fluid inlet and the clean fluid outlet are located at the first end of the cyclone chamber, the first cyclonic cleaning stage comprises a dirt collection region in communication with a dirt outlet of the cyclone chamber, and the dirt collection region is located at the second end of the cyclone chamber.

7. The hand vacuum cleaner of claim 1 wherein the handle portion extends away from a fluid flow motor housing of the main body.

8. The hand vacuum cleaner of claim 1 wherein the cyclone chamber extends longitudinally along a first longitudinal axis, the fluid flow motor has a fluid flow motor axis, and the fluid flow motor as extends transverse to the first longitudinal axis, is parallel to the passage axis and is displaced from the passage axis in a direction parallel to the longitudinal axis.

9. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (d) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber, wherein the cyclone chamber extends longitudinally along a first longitudinal axis, and the fluid flow motor has an axis that extends transverse to the first longitudinal axis, is displaced from the passage axis in a direction parallel to the longitudinal axis and is parallel to the passage axis.

10. The hand vacuum cleaner of claim 9 wherein the fluid flow motor axis is displaced from the passage axis in a direction parallel to the longitudinal axis.

11. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (d) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber, wherein the fluid flow motor has a fluid flow motor axis that is parallel to the passage axis and is displaced from the passage axis in a direction parallel to the longitudinal axis.

12. The hand vacuum cleaner of claim 10 wherein the fluid flow motor is positioned rearward of the first cyclonic cleaning stage.

13. The hand vacuum cleaner of claim 1 wherein the fluid flow motor is positioned rearward of the first cyclonic cleaning stage.

14. The hand vacuum cleaner of claim 1 wherein the first cyclonic cleaning stage comprises a dirt collection region and the dirt collection region is positioned below the wand when the hand vacuum cleaner is positioned on a horizontal surface.

15. A hand vacuum cleaner further comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a second cyclonic cleaning stage comprising plurality of cyclones, each cyclone of the plurality of cyclones has a fluid inlet and the fluid inlets of the plurality of cyclones are provided at the first end of the second cyclonic cleaning stage;

(d) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (e) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber and wherein, when the hand vacuum cleaner is positioned on a horizontal surface, the first end of the second cyclonic cleaning stage is positioned above the first end of the first cyclonic cleaning stage and above the wand.

16. The hand vacuum cleaner of claim 1 wherein, when the hand vacuum cleaner is positioned on a horizontal surface, the first end of the cyclone chamber is positioned above the second end of the cyclone chamber, a first end of a second cyclonic cleaning stage is positioned above a second end of the second cyclonic cleaning stage and the first end of the second cyclonic cleaning stage is positioned above the first end of the cyclone chamber.

17. The hand vacuum cleaner of claim 1 further comprising a dirt collection region which is removably mounted to the hand vacuum cleaner.

18. The hand vacuum cleaner of claim 1 wherein the fluid flow motor has a fluid flow motor axis, and a flow path from a pre-motor filter to the fluid flow motor comprises a portion that is parallel to the fluid flow motor axis and is spaced from the passage axis.

19. The hand vacuum cleaner of claim 1 wherein the clean fluid outlet comprises a conduit that extends into the cyclone chamber and the passage axis intersects the conduit.

20. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a second cyclonic cleaning stage comprising a plurality of cyclones wherein each of the first and second cyclonic cleaning stages has a longitudinal axis and the axes are parallel;

(d) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (e) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber.

21. A hand vacuum cleaner comprising:

(a) a main body comprising a fluid flow motor;

(b) a first cyclonic cleaning stage having first and second spaced apart ends and comprising a cyclone chamber, the cyclone chamber having first and second spaced apart ends, a dirty fluid inlet located at a front end of the hand vacuum cleaner and a clean fluid outlet, the dirty fluid inlet defining a passage extending along a passage axis that intersects the clean fluid outlet;

(c) a second cyclonic cleaning stage comprising a plurality of cyclones;

(d) a handle comprising a handle portion that extends upwardly when the hand vacuum cleaner is positioned on a horizontal surface wherein the handle portion is positioned rearward of the first cyclonic cleaning stage whereby a portion of the cyclone chamber is positioned between the dirty fluid inlet and the handle portion; and, (e) a wand mounted to the dirty fluid inlet, the wand having a distal inlet that is mounted on a surface cleaning head, whereby fluid exiting the wand travels directly into the dirty fluid inlet and from the dirty fluid inlet directly into the cyclone chamber and wherein each of the first and second cyclonic cleaning stages has a central longitudinal axis and the fluid flow motor and the handle are positioned rearward of the central axis.

22. The hand vacuum cleaner of claim 21 wherein the first cyclonic cleaning stage comprises a dirt collection region, the dirt collection region has a pivotally openable bottom and the fluid flow motor and the handle are positioned rearward of the pivotally openable bottom.

* * * * *

UNITED STATES PATENT AND TRADEMARK OFFICE

CERTIFICATE OF CORRECTION

PATENT NO. : 9,084,522 B2
APPLICATION NO. : 14/488449
DATED : July 21, 2015
INVENTOR(S) : Wayne Ernest Conrad It is certified that error appears in the above-identified patent and that said Letters Patent is hereby corrected as shown below:

Claims

Claim 8, column 9, line 1, "fluid flow motor as extends transverse" should read -- fluid flow motor axis extends transverse --

Claim 15, column 10, line 1, "hand vacuum cleaner further comprising" should read -- hand vacuum cleaner comprising --

Signed and Sealed this
Sixteenth Day of February, 2016

Michelle K. Lee

Michelle K. Lee
*Director of the United States Patent and Trademark Office*